US010328352B1

(12) United States Patent
Tam

(10) Patent No.: US 10,328,352 B1
(45) Date of Patent: Jun. 25, 2019

(54) WATER SLIDE EXTENSION SYSTEM

(71) Applicant: Gail Tam, Clinton Township, MI (US)

(72) Inventor: Gail Tam, Clinton Township, MI (US)

( * ) Notice: Subject to any disclaimer, the term of this patent is extended or adjusted under 35 U.S.C. 154(b) by 0 days.

(21) Appl. No.: 15/873,671

(22) Filed: Jan. 17, 2018

(51) Int. Cl.
*A63G 21/18* (2006.01)

(52) U.S. Cl.
CPC ..... *A63G 21/18* (2013.01)

(58) Field of Classification Search
CPC .. A63G 31/007; B05B 9/0423; B05B 15/061; A63B 21/18
See application file for complete search history.

(56) References Cited

U.S. PATENT DOCUMENTS

| | | | | |
|---|---|---|---|---|
| 4,805,898 | A | 2/1989 | Jacober et al. | |
| 6,146,282 | A * | 11/2000 | McCready | A63G 21/18 472/116 |
| D451,567 | S | 12/2001 | Gordon | |
| 6,406,377 | B1 | 6/2002 | Demko | |
| 6,416,282 | B1 | 7/2002 | Beeck et al. | |
| 6,558,246 | B2 | 5/2003 | Gordon | |
| 9,217,259 | B1 * | 12/2015 | Perrotta | E04H 4/14 |

* cited by examiner

*Primary Examiner* — Michael D Dennis

(57) ABSTRACT

A water slide extension system for sliding down and for recreational use includes a slide that has a top surface, a bottom surface, an entrance end and an exit end. The exit end is perpendicular to a ground surface. A water dispenser is included and placed on the slide to dispense water onto the slide. An extension is releasably coupled to the exit end of the slide. The extension catches water from the slide and receives a person from the slide such that the person slides on to the extension. A plurality of coupling units is attached to the extension. Each of the coupling units releasably couples the extension to the ground surface.

7 Claims, 6 Drawing Sheets

WATER SLIDE EXTENSION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to slide devices and more particularly pertains to a new slide device for sliding down and for recreational use.

BRIEF SUMMARY OF THE INVENTION

An embodiment of the disclosure meets the needs presented above by generally comprising a slide that has a top surface, a bottom surface, an entrance end and an exit end. The exit end is perpendicular to a ground surface. A water dispenser is included and placed on the slide to dispense water onto the slide. An extension is releasably coupled to the exit end of the slide. The extension catches water from the slide and is configured to receive a person from the slide such that the person slides on to the extension. A plurality of coupling units is attached to the extension. Each of the coupling units releasably couples the extension to the ground surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
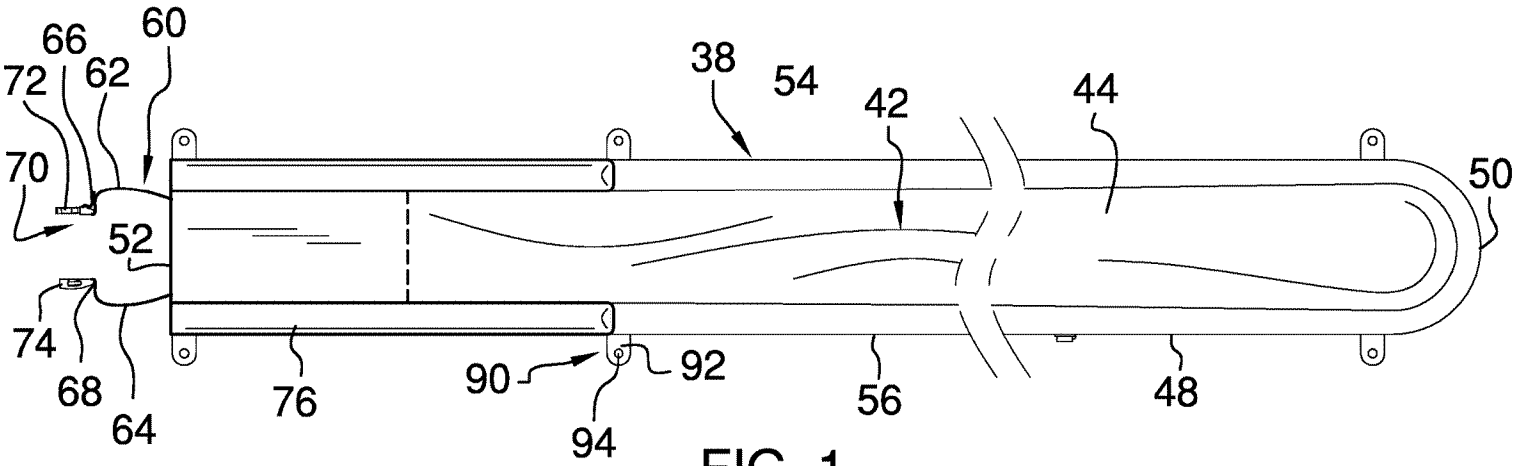
FIG. 1 is a top view of a water slide extension system according to an embodiment of the disclosure.
Figure 2:
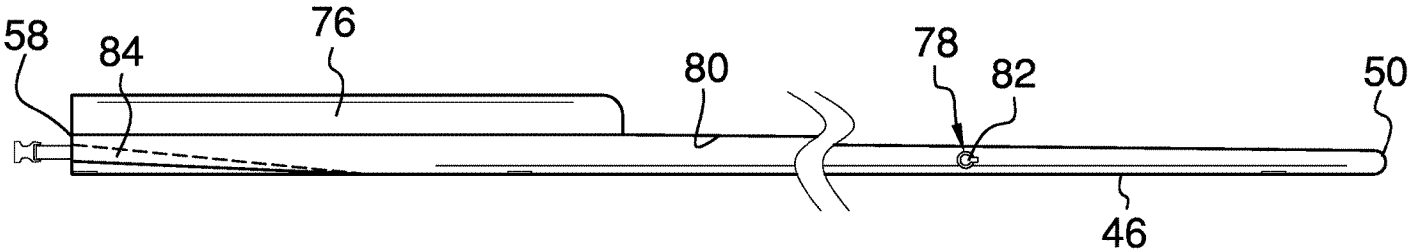
FIG. 2 is a side view of an embodiment of the disclosure.
Figure 3:
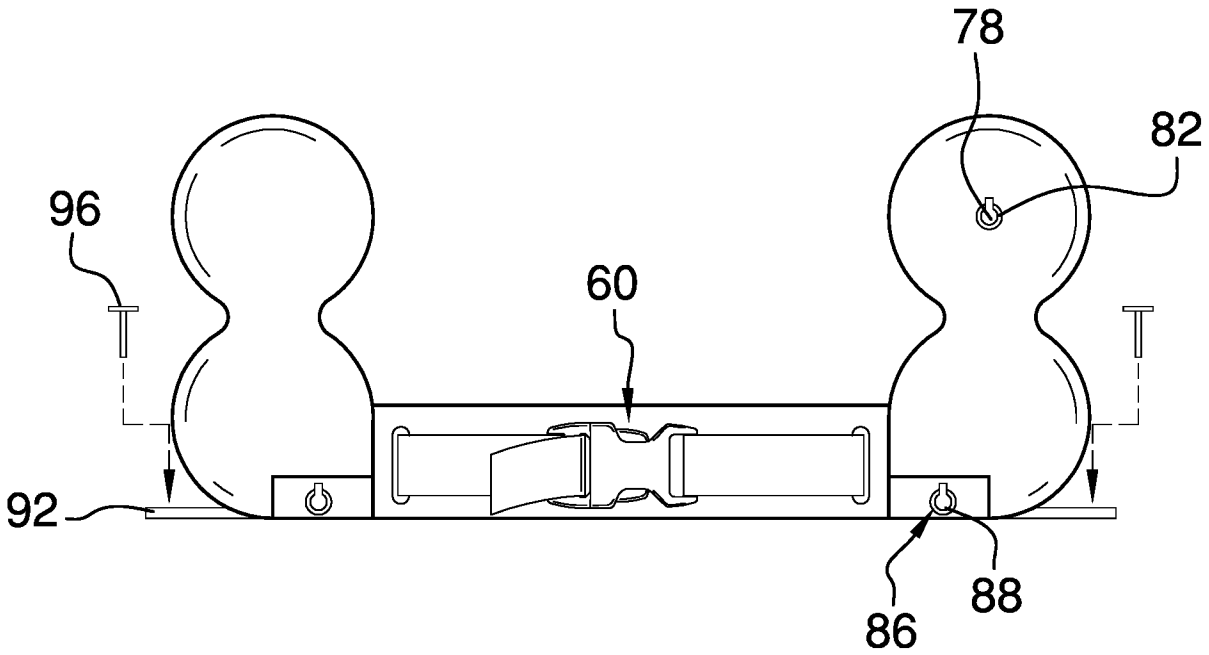
FIG. 3 is a back view of an embodiment of the disclosure.
Figure 4:
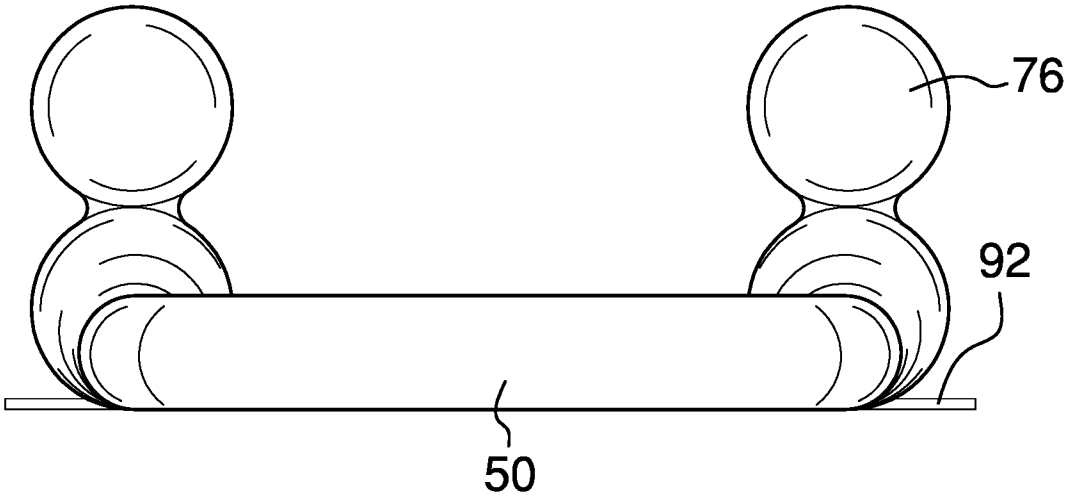
FIG. 4 is a front view of an embodiment of the disclosure.
Figure 5:
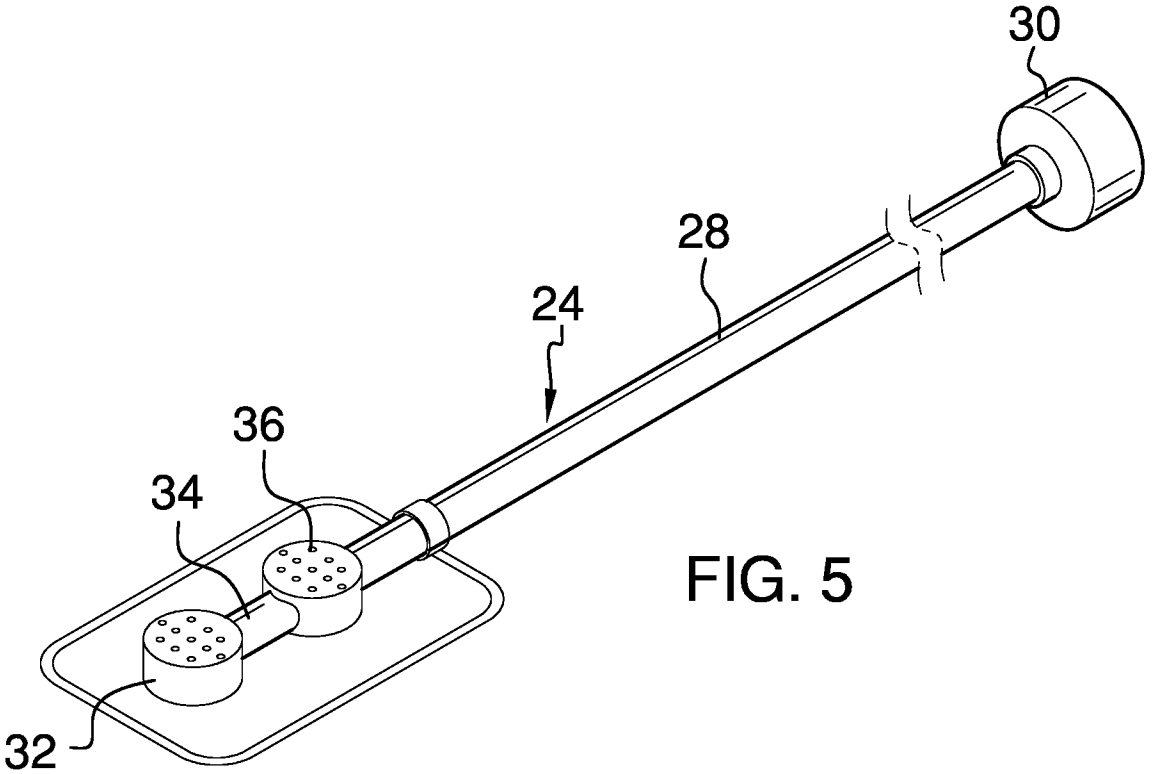
FIG. 5 is a component view of an embodiment of the disclosure.
Figure 6:
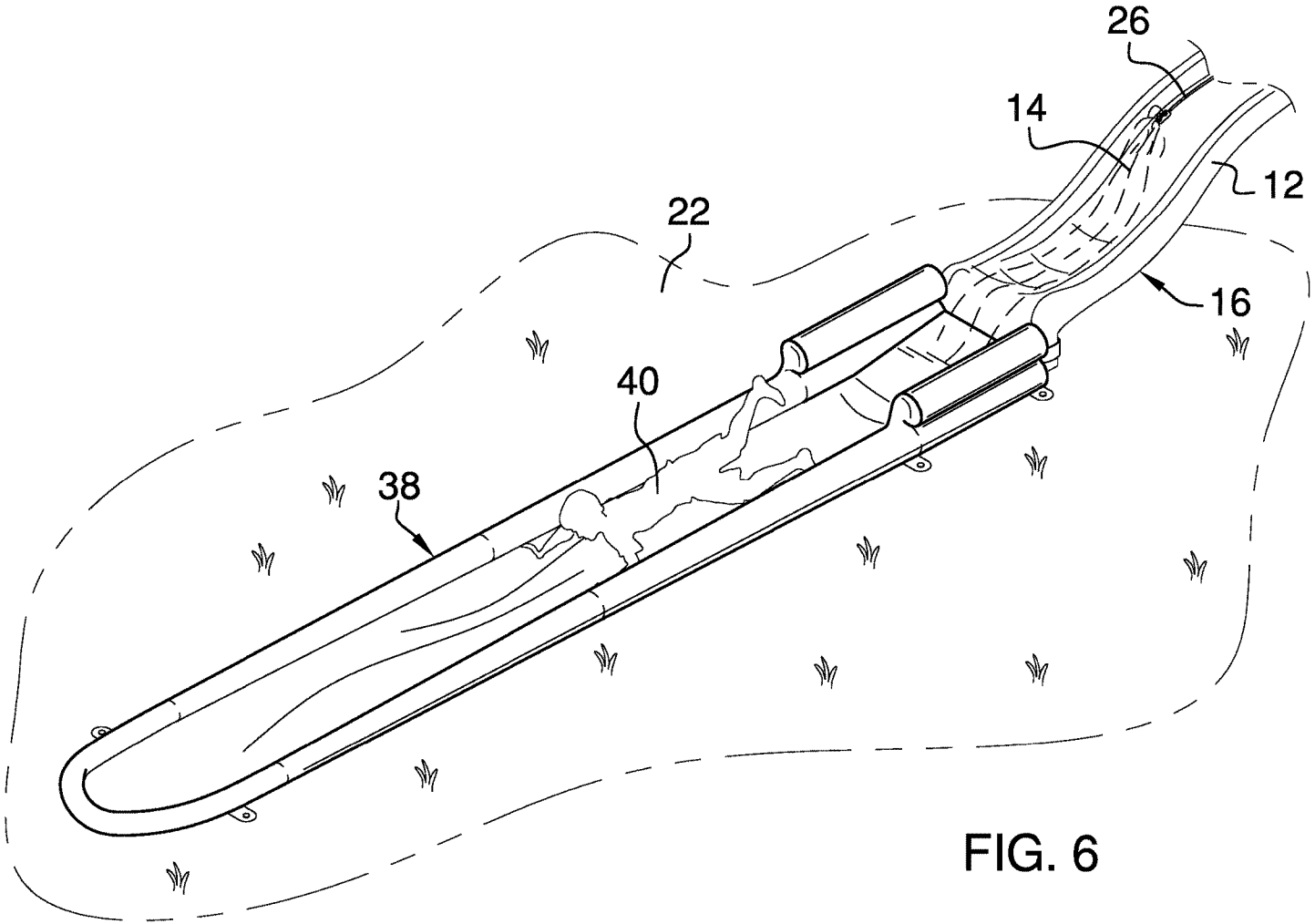
FIG. 6 is a top side view of an embodiment of the disclosure.
Figure 7:
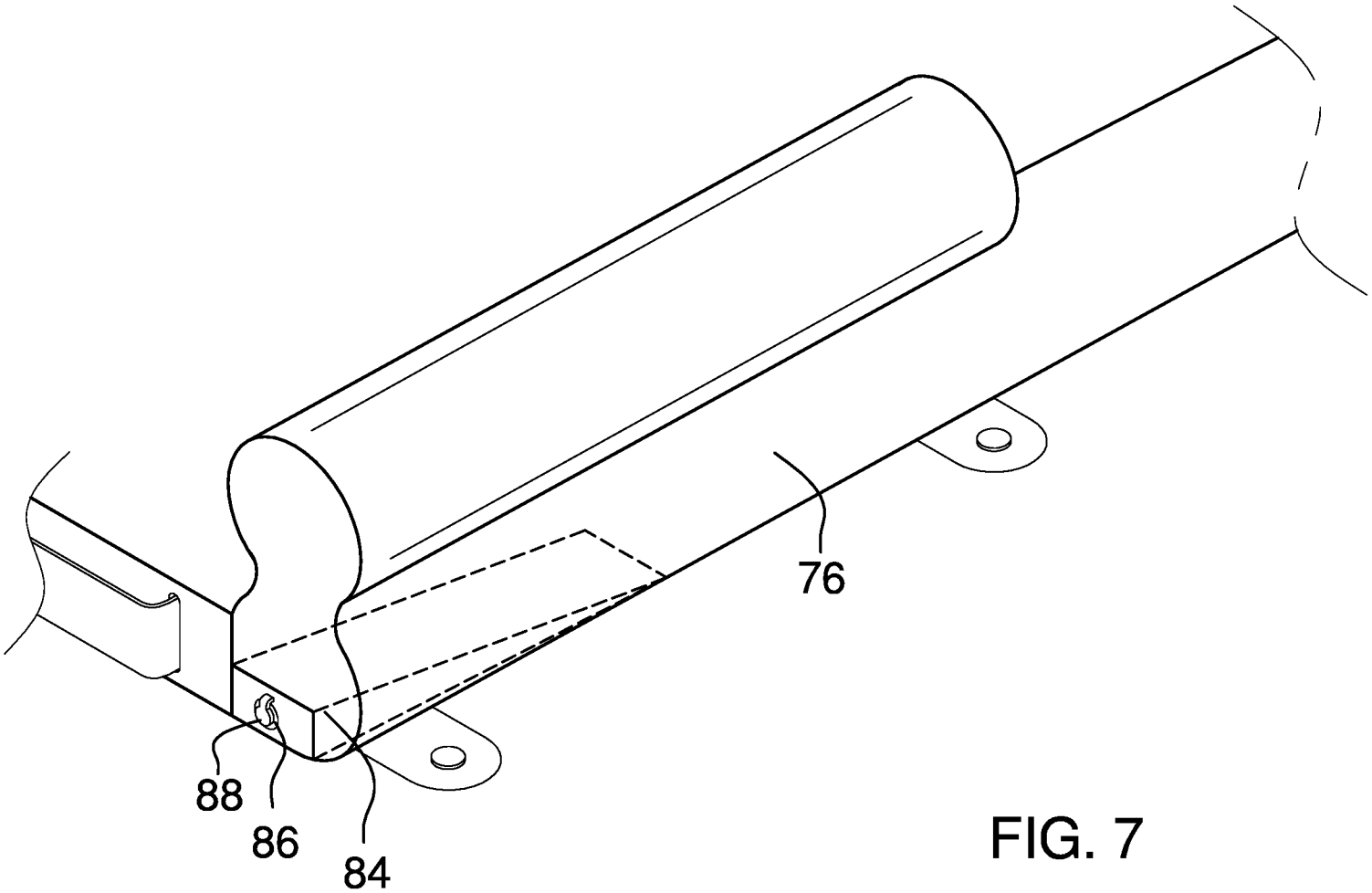
FIG. 7 is a top side view of an embodiment of the disclosure.

With reference now to the drawings, and in particular to FIGS. 1 through 7 thereof, a new slide device embodying the principles and concepts of an embodiment of the disclosure and generally designated by the reference numeral 10 will be described.

As best illustrated in FIGS. 1 through 7, the water slide extension system 10 generally comprises a slide 12 that has a top surface 14, a bottom surface 16, an entrance end 18 and an exit end 20. The exit end 20 is perpendicular to a ground surface 22. The exit end 20 may abut the ground surface 22 but does not necessarily need to do so.

A water dispenser 24 is included and may be positioned on the top surface 14 of the slide 12 adjacent to the entrance end 18. The water dispenser 24 is in fluid communication with the top surface 14 of the slide 12. The water dispenser 24 takes in water from a water supply 26 and dispenses the water outwardly onto the top surface 14 of the slide. The water dispenser 24 comprises a tube 28 that has a coupling end 30 and a dispensing end 32. The coupling end 30 is fluidly coupled to the water supply 26. The tube 28 has a dispensing portion 34 that is spaced from the dispensing end 32. The dispensing portion 34 has a release aperture 36 that extends therein. The release aperture 36 is in fluid communication with the coupling end 30 wherein the water flows into the tube 28 and outwardly from the release aperture 36 onto the slide 12.

An extension 38 is releasably coupled to the exit end 20 of the slide 12. The extension 38 catches water from the slide 12 and receives a person 40 from the slide 12 such that the person 40 slides on the extension 38. The extension 38 comprises a panel 42 that has a upper surface 44, a lower surface 46 and a perimeter edge 48 that extends between the upper surface 44 and the lower surface 46. The perimeter edge 48 includes a forward edge 50, a rear edge 52, a first lateral edge 54 and a second lateral edge 56. The panel 42 comprises a low friction material. A rear wall 58 is attached to and extends upwardly from the rear edge 52. The rear wall 58 is positioned adjacent to the exit end 20 of the slide 12 and comprises a rigid material.

A securing member 60 is attached to and extends away from the rear wall 58. The securing member 60 releasably secures the rear wall 58 to the slide 12. The securing member 60 includes a first strap 62 and second strap 64. Each of the first strap 62 and the second strap 64 has a free end 66, 68. The free end 66 of the first strap 62 and the free end 68 of the second strap 64 extend around the slide 12 adjacent to the exit end 20. The securing member 60 includes a coupler 70 that releasably secures the first strap 62 to the second strap 64. The coupler 70 includes a first mating member 72 and a second mating member 74. The first mating member 72 is positioned adjacent to the free end 66 of the first strap 62. The second mating member 74 is positioned adjacent to the free end 68 of the second strap 64. The first mating member 72 engages the second mating member 74 to secure the rear wall 58 to the slide 12.

A peripheral wall 76 is attached to and extends upwardly from continuously along the forward edge 50, the first lateral edge 54 and the second lateral edge 56. The peripheral wall 76 is attached to the rear wall 58. The peripheral wall 76 is inflatable and has an air inlet 78 that extends into an interior 80 of the peripheral wall 76 wherein air is blown into the air inlet 78 to inflate the peripheral wall 76. The peripheral wall 76 has a first height adjacent to the rear edge 52 and a second height adjacent to the forward edge 50. The first height is greater than the second height and the peripheral wall 76 tapers downwardly from the rear edge 52 to the forward edge 50.

Additionally, a plug 82 is included and is removably extended into the air inlet 78. When removed the interior 80 of the peripheral wall 76 is in fluid communication with air outside of the peripheral wall 76. A water chamber 84 is positioned in the peripheral wall 76 and fillable with water to increase a weight of the extension 38. A water inlet 86 is in fluid communication with the water chamber 84. A cap 88 is removably positioned on the water inlet 86. When the cap 88 is removed the water chamber 84 is fillable with water to increase the weight of the extension 38.

A plurality of coupling units 90 is attached to the extension 38. Each of the coupling units 90 releasably couples the extension 38 to the ground surface 22. Each of the coupling units 90 comprises a tether 92 that is attached to the perimeter edge 48 of the extension 38 and extends outwardly therefrom. The tether 92 has a coupling aperture 94 that extends therethrough. A stake 96 extends through the coupling aperture 96 of the tether 92 and into the ground surface 22 to secure the extension 38 to the ground surface 22.

In use, the rear wall 58 is placed adjacent to the slide 12 wherein the first strap 62 and the second strap 64 are extended around the slide 12 and coupled together with the first mating member 72 and the second mating member 74. The peripheral wall 76 is filled with air and the water chamber 84 is filled with water. The water dispenser 24 is attached to the water supply 26 and releases water onto the slide 12 and into the extension 38. A person 40 then slides down the slide 12 into the extension 38 towards the forward edge 50 of the panel 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A water slide system:

a slide having a top surface, a bottom surface, an entrance end and an exit end, said exit end being perpendicular to a ground surface;

a water dispenser;

an extension being releasably coupled to said exit end of said slide, said extension catching water from said slide and being configured to receive a person from said slide such that the person slides onto said extension, said extension comprising a panel having an upper surface, a lower surface and a perimeter edge extending between said upper surface and said lower surface, said perimeter edge including a forward edge, a rear edge, a first lateral edge and a second lateral edge, said panel comprising a low friction material, said extension further including a rear wall being attached to and extending upwardly from said rear edge, said rear wall being positioned adjacent to said exit end of said slide, said rear wall comprising a rigid material, said extension further including a securing member being attached to and extending away from said rear wall, said securing member releasably securing said rear wall to said slide, said securing member includes a first strap and second strap, each of said first strap and said second strap having a free end, said free end of said first strap and said free end of said second strap extending around said slide adjacent to said exit end, said securing member including a coupler releasably securing said first strap to said second strap, said coupler including a first mating member and a second mating member, said first mating member being positioned adjacent to said free end of said first strap, said second mating member being positioned adjacent to said free end of said second strap, said first mating member engaging said second mating member to secure said rear wall to said slide, said extension further including a peripheral wall being attached to and extending upwardly from continuously along said forward edge, said first lateral edge and said second lateral edge, said peripheral wall being attached to said rear wall, said peripheral wall being inflatable, said peripheral wall having an air inlet extending into an interior of said peripheral wall wherein air blown into said air inlet to inflate said peripheral wall, said peripheral wall having a first height adjacent to said rear edge and a second height adjacent to said forward edge, said first height being greater than said second height wherein said peripheral wall tapers downwardly from said rear edge to said forward edge; and a plurality of coupling units being attached to said extension, each of said coupling units releasably coupling said extension to said ground surface.

2. The water slide system according to claim 1, wherein said extension further includes a plug being removably extended into said air inlet.

3. The water slide system according to claim 2, wherein said extension further includes a water chamber being positioned in said peripheral wall, said water chamber being configured to be filled with water to increase a weight of said extension, a water inlet being in fluid communication with said water chamber.

4. The water slide system according to claim 3, wherein said extension further includes a cap being removably positioned on said water inlet.

5. The water slide system according to claim 1, wherein each of said coupling units comprises a tether being attached to said perimeter edge of said extension and extending outwardly therefrom, said tether having a coupling aperture extending therethrough.

6. The water slide system according to claim 5, wherein each of said coupling units further include a stake extending through said coupling aperture of said tether and into said ground surface to secure said extension to said ground surface.

7. A water slide system:

a slide having a top surface, a bottom surface, an entrance end and an exit end, said exit end being perpendicular to a ground surface;

a water dispenser an extension being releasably coupled to said exit end of said slide, said extension catching water from said slide and being configured to receive a person from said slide such that the person slides onto said extension, said extension comprising a panel having a upper surface, a lower surface and a perimeter edge extending between said upper surface and said lower surface, said perimeter edge including a forward edge, a rear edge, a first lateral edge and a second lateral edge, said panel comprising a low friction material;

a rear wall being attached to and extending upwardly from said rear edge, said rear wall being positioned adjacent to said exit end of said slide, said rear wall comprising a rigid material;

a securing member being attached to and extending away from said rear wall, said securing member releasably securing said rear wall to said slide, said securing member including a first strap and second strap, each of said first strap and said second strap having a free end, said free end of said first strap and said free end of said second strap extending around said slide adjacent to said exit end, said securing member including a coupler releasably securing said first strap to said second strap, said coupler including a first mating member and a second mating member, said first mating member being positioned adjacent to said free end of said first strap, said second mating member being positioned adjacent to said free end of said second strap, said first mating member engaging said second mating member to secure said rear wall to said slide;

a peripheral wall being attached to and extending upwardly from continuously along said forward edge, said first lateral edge and said second lateral edge, said peripheral wall being attached to said rear wall, said peripheral wall being inflatable, said peripheral wall having an air inlet extending into an interior of said peripheral wall wherein air blown into said air inlet to inflate said peripheral wall, said peripheral wall having a first height adjacent to said rear edge and a second height adjacent to said forward edge, said first height being greater than said second height wherein said peripheral wall tapers downwardly from said rear edge to said forward edge;

a plug being removably extended into said air inlet;

a water chamber being positioned in said peripheral wall, said water chamber being configured to be filled with water to increase a weight of said extension, a water inlet being in fluid communication with said water chamber;

a cap being removably positioned on said water inlet a plurality of coupling units being attached to said extension, each of said coupling units releasably coupling said extension to said ground surface, each of said coupling units comprising:

a tether being attached to said perimeter edge of said extension and extending outwardly therefrom, said tether having a coupling aperture extending therethrough; and a stake extending through said coupling aperture of said tether and into said ground surface to secure said extension to said ground surface.

* * * * *